US005858633A

United States Patent [19]

Chen et al.

[11] Patent Number: 5,858,633

[45] **Date of Patent: *Jan. 12, 1999**

[54] PHOTOGRAPHIC ELEMENTS CONTAINING 3-ALKYL GROUP SUBSTITUTED 2-HYDROXYPHENYLBENZOTRIAZOLE UV ABSORBING POLYMERS

[75] Inventors: Tienteh Chen, Penfield; Hwei-Ling Yau, Rochester, both of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

The term of this patent shall not extend beyond the expiration date of Pat. No. 5,384,235.

[21] Appl. No.: 857,375

[22] Filed: May 16, 1997

Related U.S. Application Data

[63] Continuation of Ser. No. 361,279, Dec. 21, 1994, abandoned.

[51] Int. Cl.[6] ..... G03C 1/815

[52] U.S. Cl. ..... 430/512; 430/931; 524/91; 548/260

[58] Field of Search ..... 430/512, 931; 524/91; 548/260; 252/589

[56] References Cited

U.S. PATENT DOCUMENTS

| | | | |
|---|---|---|---|
| 3,215,530 | 11/1965 | Riebel | 96/48 |
| 3,253,921 | 5/1966 | Sawdey | 96/73 |
| 3,278,448 | 10/1966 | Lauerer et al. | 252/300 |
| 3,352,681 | 11/1967 | Ohi et al. | 96/84 |
| 3,705,805 | 12/1972 | Nittel et al. | 96/84 |
| 3,707,375 | 12/1972 | Reiichi et al. | 96/84 |
| 3,738,837 | 6/1973 | Kuwabara et al. | 96/84 |
| 3,745,010 | 7/1973 | Janssens et al. | 96/84 |
| 3,761,272 | 9/1973 | Godfried et al. | 96/84 |
| 4,045,229 | 8/1977 | Weber, II et al. | 96/84 |
| 4,307,184 | 12/1981 | Beretta et al. | 430/512 |
| 4,340,664 | 7/1982 | Monbaliu et al. | 430/449 |
| 4,455,368 | 6/1984 | Kojima et al. | 430/507 |
| 4,464,462 | 8/1984 | Sugimoto et al. | 430/512 |
| 4,513,080 | 4/1985 | Helling | 430/537 |
| 4,528,311 | 7/1985 | Beard et al. | 524/91 |
| 4,551,420 | 11/1985 | Sugimoto et al. | 430/505 |
| 4,611,061 | 9/1986 | Beard et al. | 548/260 |
| 4,716,234 | 12/1987 | Dunks et al. | 548/259 |
| 4,752,298 | 6/1988 | Burglin et al. | 8/527 |
| 4,790,959 | 12/1988 | Sasaki et al. | 252/589 |
| 4,853,471 | 8/1989 | Rody et al. | 548/261 |
| 4,865,957 | 9/1989 | Sakai et al. | 430/505 |
| 4,943,519 | 7/1990 | Helling et al. | 430/512 |
| 5,372,922 | 12/1994 | Schofield et al. | 430/572 |
| 5,384,235 | 1/1995 | Chen et al. | 430/512 |
| 5,385,815 | 1/1995 | Schofield et al. | 430/512 |

FOREIGN PATENT DOCUMENTS

| | | |
|---|---|---|
| 0 190 003 | 9/1991 | European Pat. Off. . |
| 0 577 122 A1 | 5/1994 | European Pat. Off. . |
| 1 338 265 | 11/1973 | United Kingdom . |
| 1338265 | 11/1973 | United Kingdom . |
| 1 346 764 | 2/1974 | United Kingdom . |
| 1 504 949 | 3/1978 | United Kingdom . |
| 1 504 950 | 3/1978 | United Kingdom . |

OTHER PUBLICATIONS

Related Application USSN 07/907,008 filed Jul. 1, 1992 Photographic Elements Incorporating Polymeric Ultraviolet Absorbers, TChen et al.

*Primary Examiner*—Richard L. Schilling
*Attorney, Agent, or Firm*—Edith A. Rice

[57] ABSTRACT

Photographic elements containing 3-tertiary alkyl group substituted 2-hydroxyphenylbenzotriazole UV absorbing polymers. In particular, a photographic element having at least one layer containing a light sensitive silver halide emulsion and at least one layer which is not light sensitive, the element having in at least one of the layers an ultraviolet absorbing polymer which includes units formed from monomers of the structure of formula (I):

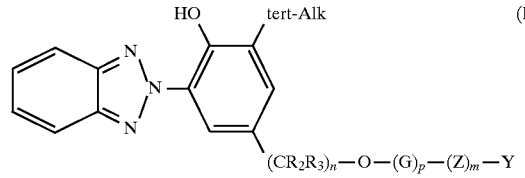

(I)

wherein:

n is an integer of 1 to 6;

p and m are, independently, 0 or 1;

tert-Alk is a 4 to 10 carbon atom tertiary alkyl group;

G is —CO—, —C(O)—, —C(O)NH—, or —$SO_2$—;

$R_2$ and $R_3$ are, independently, H, halogen, alkyl group or alkoxy group, and if n is more than 1 all of the $R_2$ may be the same or different and all of the $R_3$ may be the same or different; the benzene ring of the benzotriazole and the phenyl ring phenol group each may be further substituted or unsubstituted;

z is an arylene group, alkylene group, or alkylene group which is interrupted by O, N or a group of the type which G can represent; and Y is an ethylenically unsaturated polymerizable group.

9 Claims, No Drawings

PHOTOGRAPHIC ELEMENTS CONTAINING 3-ALKYL GROUP SUBSTITUTED 2-HYDROXYPHENYLBENZOTRIAZOLE UV ABSORBING POLYMERS

This is a Continuation of application Ser. No. 08/361,279, filed Dec. 21, 1994, now abandoned.

FIELD OF THE INVENTION

This invention relates to photographic elements which include ultraviolet absorbing polymers of the 2-hydroxyphenylbenzotriazole type with a 3-tertiary alkyl group substituent.

BACKGROUND OF THE INVENTION

Typical photographic elements use silver halide emulsions, the silver halide having a native sensitivity to ultraviolet UV radiation ("UV"). UV radiation is usually regarded as anything less than about 400 nm. Such UV sensitivity is usually undesirable in that it produces an image on the photographic element which is not visible to the human eye. In addition, in the case of color photographic elements, in particular, color dye images formed on the light sensitive emulsion layers by color development easily undergo fading or discoloration due to the action of UV. Also, color formers, or so-called couplers, remaining in the emulsion layers are subject to the action of UV to form undesirable color stains on the finished photographs. The fading and the discoloration of the color images are easily caused by UV of wavelengths near the visible region, namely, those of wavelengths from 300 to 400 nm. For the foregoing reasons, photographic elements typically incorporate a UV absorbing material in an upper layer.

Many types of UV absorbing materials have been described previously, and include those described in U.S. Pat. Nos. 3,215,530, 3,707,375, 3,705,805, 3,352,681, 3,278,448, 3,253,921, and 3,738,837, 4,045,229, 4,790,959. 4,853,471, 4,865,957, and 4,752,298, and United Kingdom Patent 1,338,265. Known UV absorbing materials often have many undesirable characteristics. For example, they tend to color and form stains due to their insufficient stability to UV, heat, and humidity. Also, a high-boiling organic solvent is usually required for the emulsification of the UV absorbing agents, which softens the layer and substantially deteriorates interlayer adhesion. In order to prevent these problems, a large amount of gelatin has been used in the layer containing the UV absorbent, resulting in a layer which may be unstable. Alternatively, a separate gelatin protective layer was provided over the UV absorbent containing layer. Such approach results in an undesirable thickening of the element. Furthermore, previously known UV absorbing agents, when provided in the uppermost layer of a photographic element, often migrate and crystallize at the surface of the layer. Thus, a gel overcoat would be used to minimize this undesirable blooming phenomenon. Furthermore, the droplets of such UV absorbing materials, when prepared by the conventional emulsification method described above, usually have particle sizes greater than 200 nm thereby producing light scattering with resulting deterioration of the element's photographic properties. The toxicity of such UV absorbing agents has also become an important issue recently.

It is known that polymer latexes obtained by polymerization of UV absorbing monomers, can be utilized as UV absorbing agents which do not have many of the disadvantages described above. Polymeric UV absorbing polymer latexes and their preparation have been described in, for example, U.S. Pat. Nos. 3,761,272; 3,745,010; 4,307,184; 4,455,368; 4,464,462; 4,513,080; 4,340,664; GB 1,504,949; GB 1,504,950; British Patent 1,346,764; EP Application 0 190 003 and others.

Some polymer latexes containing polymers of certain specific structures, have been previously used in photographic elements. For example, U.S. Pat. No. 4,551,420 and U.S. Pat. No. 4,464,462 describe photographic elements with polymer latexes. U.S. Pat. No. 4,943,519 describes the use of latexes formed from various ultraviolet absorbing polymers in photographic film. U.S. Pat. No. 4,528,311, U.S. Pat. No. 4,611,061, and U.S. Pat. No. 4,716,234 describe the use of polymeric UV absorbers containing units formed from 2-hydroxy-3-alkyl-5-(methacryloxyalkyl)-2-benzotriazole for use in contact lenses and intraocular lenses.

These polymeric UV absorbers (a UV absorbing compound sometimes being referenced herein as "UVA") have one or more of the following problems: (1) the UV absorbing monomer itself is hard to synthesize; (2) the UV absorbing monomer is hard to polymerize by emulsion polymerization; (3) the absorption spectrum of the polymeric UV absorber is not desirable; (4) the light stability of the polymeric UV absorber is relatively poor; (5) the photographic performance of the polymeric UV absorber, such as fresh Dmin (that is, the minimum density), dye fade, and dye stain, are not satisfactory. It is thus desirable to have a photographic element which uses a polymeric UV absorbing compound which has at least one of the foregoing characteristics improved.

SUMMARY OF THE INVENTION

The present invention therefore provides a photographic element having at least one layer containing a light sensitive silver halide emulsion and at least one layer which is not light sensitive, the element having in at least one of the layers an ultraviolet absorbing polymer which includes units formed from monomers of the structure of formula (I):

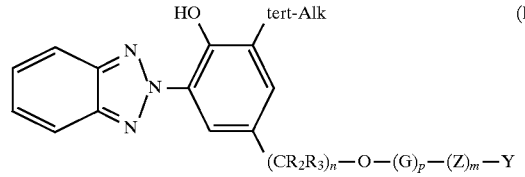

(I)

wherein:

n is an integer of 1 to 6;

p and m are, independently, 0 or 1;

tert-Alk is a 4 to 10 carbon atom tertiary alkyl group (for example, t-butyl, t-amyl, or t-hexyl);

G is —CO—, —C(O)—, —C(O)NH—, OR —$SO_2$—;

$R_2$ and $R_3$ are, independently, H, halogen, alkyl group or alkoxy group, and if n is more than 1 all of the $R_2$ may be the same or different and all of the $R_3$ may be the same or different; the benzene ring of the benzotriazole and the phenyl ring phenol group each may be further substituted or unsubstituted;

Z is an arylene group, alkylene group, or alkylene group which is interrupted by O, N or a group of the type which G can represent; and Y is an ethylenically unsaturated polymerizable group (that is, it contains an unsaturated ethylene type double bond which can be polymerized).

Photographic elements containing such a UV absorbing polymer tend to have one or more of: a good UV absorption spectrum, good light stability, and good photographic performance. Additionally, the UV absorbing monomer of formula (I) is typically relatively easy to synthesize and polymerize.

EMBODIMENTS OF THE INVENTION

By reference to "under", "above", "below", "upper", "lower" or the like terms in relation to layer structure of a photographic element, is meant in this application, the relative position in relation to light to when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or "under" would mean closer to the support.

In reference to "polymers" having units formed from monomers of formula (I), this means that the compound would contain at least 10 (and preferably at least 20 and more preferably at least 50) repeating units of the monomer of formula (I). Typically the polymers would have hundreds (for example, three hundred or more) or several thousand (for example, three thousand or more) repeating units. For a compound to be considered a UV absorbing one in the present invention, it should at least absorb somewhere in the 300 to 400 nm region of the spectrum. When reference in this application is made to a substituent "group", this means that the substituent may itself be substituted or unsubstituted (for example "alkyl group" refers to a substituted or unsubstituted alkyl). Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Substituents on the benzene ring of the benzotriazole or the phenyl ring of the phenol group, where allowed in any of the above formulae may, for example, independently be 1 to 18 carbon alkyl (or 1 to 6, or 1 to 2 carbon alkyl), aryl (such as 6 to 20 carbon atoms), heteroaryl (such as pyrrolo, furyl or thienyl), aryloxy (such as 6 to 20 carbon atoms) alkoxy (such as 1 to 6 or 1 to 2 carbon alkoxy), cyano, or halogen (for example F or Cl, particularly having Cl on the benzo ring at the 5 and/or 6 position, and/or on the hydroxy substituted phenyl at the 5' position). Substituents for the benzo ring can also include ring fused thereto, such as a benzo, pyrrolo, furyl or thienyl ring. Any of the alkyl and alkoxy substituents may have from 1 to 5 (or 1 to 2) intervening oxygen, sulfur or nitrogen atoms. As to Z or $Z_1$, when present, they may particularly be an alkyl group (such as 1 to 10 or 1 to 3 or 4 carbon atom alkyl) or define a carbamoyl or sulfonyl group.

When Z is an alkylene group or alkylene group interrupted by the specified atoms or groups, it may particularly have 1 to 20 carbon atoms, more particularly 4 to 12 carbon atoms, in total. It will be understood that Z as an alkylene group or an interrupted alkylene group as described, includes the possibility of Z being linear or branched, or being cyclic. Examples of the linking group, Z, include $—CH_2CH_2—$, $—CH_2CH_2CH_2—$, $—CH_2CH_2OCH_2CH_2—$, $—CH_2CH_2NHCH_2CH_2—$, $—CH_2CH(OH)CH_2—$, $—CH_2CH_2OC(O)CH_2CH_2—$, $—CH_2CH_2NHCOCH_2CH_2—$, $—CH_2CH_2OCH_2CH_2OCH_2CH_2—$, —Phenyl—, or cyclohexyl group, or any of the foregoing in which one or more H is replaced by substituents as described above.

Monomers of formula (I) may particularly be of formula (Ia) below:

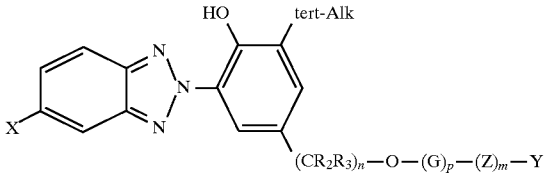

(Ia)

wherein:

the benzene ring of the benzotriazole and the phenyl ring of the phenol have no further substituents; and X is, independently: hydrogen; halogen; an alkyl group (for example, of 1 to 6 carbon atoms); an aryl group (for example, a phenyl group); an alkoxy group (for example, of 1 to 6 carbon atoms); an aryloxy group (for example, phenoxy); an alkylthio group (for example, of 1 to 6 carbon atoms); an amino group (for example, a secondary or tertiary amino such as a mono or dialkyl amino either having a total of 1 to 8 carbon atoms); an aminoalkyl group (for example, having one to 6 carbon atoms); a hydroxy; a cyano; a nitro; or an arylamino group, an acylamino group, a carbamoyl group, or an acyloxy group, (any of the foregoing, for example, having 1 to 8 or 1 to 6 carbon atoms); or a sulfonyl group, a sulfamoyl group, a sulfonamido group (any of the foregoing, for example, having 0 to 8, or 1 to 6 carbon atoms);

Y is an ethylenically unsaturated polymerizable group which is $CH_2=CH—COO—$, $CH_2=C(CH_3)—COO—$, $CH=CH—CONH—$, $CH_2=C(CH_3)—CONH—$, m-vinylbenzyl, p-vinylbenzyl, or allyl.

Monomers of structure (Ia) may particularly be of formula (Ib) below:

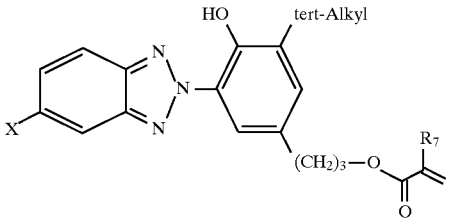

(Ib)

wherein $R_7$ is H or a 1 to 4 carbon atom alkyl.

The ultraviolet absorbing polymer in the photographic elements of the present invention will have the general formula:

$$(A)_x(B)_y$$

In the above, A is a unit formed from a UV absorbing monomer of a type of formula (I). B is any comonomer (including the possibility that B is another unit formed from a monomer of the type of formula (I) but is different from (A)). x and y can be any numbers, however particularly when B is a comonomer which is not of formula (I) (and more particularly when B is not any UV absorbing monomeric unit) preferably the ratio of y to x is no more than 20:1 (and preferably 10:1 and more preferably 4:1). y may particularly be 0 (in which case the polymer is a homopolymer consisting only of monomeric units formed from the same monomers of formula (I)) but x cannot be 0. When y is not 0, the UV absorbing polymer is a heteropolymer.

Examples of A (monomers of formula (I)) are provided below.

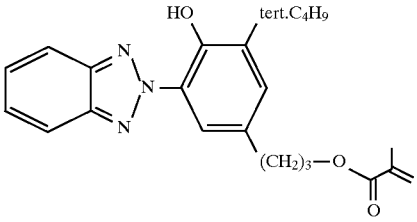

M-1

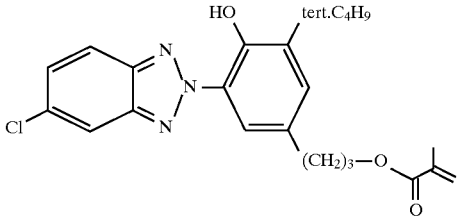

M-2

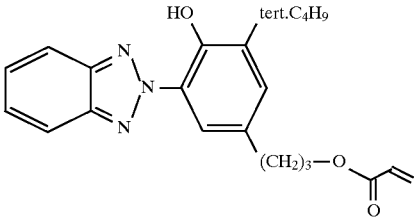

M-3

-continued

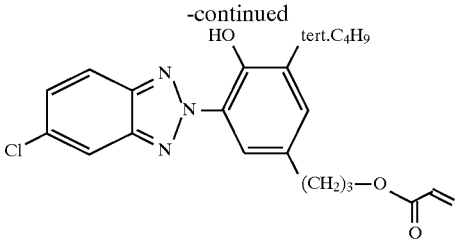

M-4

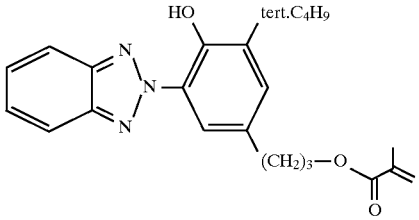

M-5

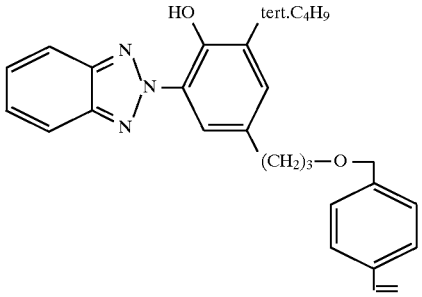

M-6

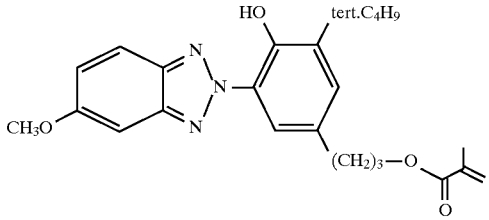

M-7

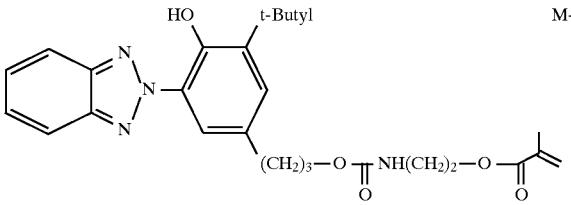

M-8

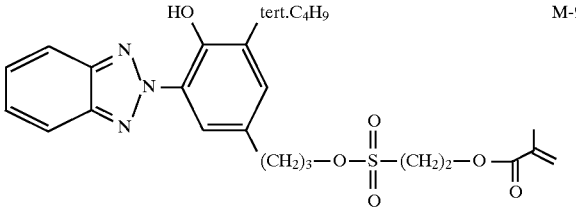

M-9

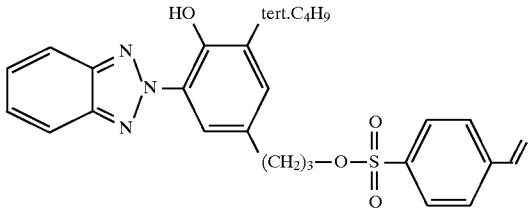

M-10

-continued

M-11

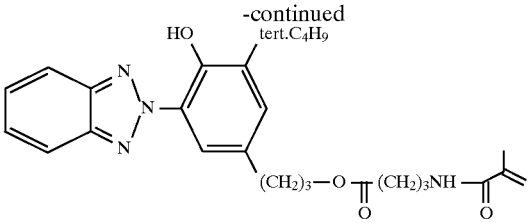

B is a unit formed from any ethylenically unsaturated comonomers, including an acrylic acid, an α-alkylacrylacid (such as methacrylic acid, etc.), an ester or amide derived from an acrylic acid or methacrylic acid(for example, acrylamide, methacrylamide, n-butylacrylamide, t-butylacrylamide, diacetone acrylamide, methyl acrylate, ethyl acrylate, n-propylacrylate, n-butyl acrylate, t-butyl acrylate, isobutyl acrylate, 2-ethylhexyl acrylate, n-octyl acrylate, lauryl acrylate, 2-ethoxyethyl acrylate, 2-methoxyethyl acrylate, methyl methacrylate, ethyl methacrylate, n-butyl methacrylate, β-hydroxyl methacrylate, etc.), a vinyl ester(for example, vinyl acetate, vinyl propionate, vinyl laurate, etc.), acrylonitrile, methacrylonitrile, an aromatic vinyl compound (for example, styrene and a derivative thereof, for example, vinyl toluene, divinylbenzene, vinyl acetophenone, sulfostyrene, etc.), itaconic acid, citraconic acid, crotonic acid, vinylidene chloride, a vinyl alkyl ether(for example, vinyl ethyl ether, etc.), an ester of maleic acid, N-vinyl-2-pyrrolidone, N-vinylpyridine, 2- or 4-vinylpyridine, etc., an sulfonic acid containing monomers, (for example, acrylamido-2,2'-dimethyl-propane sulfonic acid, 2-sulfoethyl methacrylate, 3-sulfopropyl methacylate, etc.).

Of the monomers from which B is formed, an ester of acrylic acid, an ester of methacrylic acid, and an aromatic vinyl compounds are particularly preferred.

Two or more of the above-described comonomers which form B, can be used together, for example, a combination of butyl acrylate and acrylamido-2,2'-dimethyl propane sulfonic acid.

Two or more of the UV absorbing monomers can be copolymerized together, for example, a combination of M-1 with M-2 or with other UV absorbing monomers described in the prior art. Particularly, a copolymer may contain units of the formula:

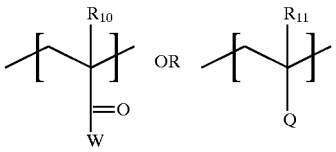

wherein: W is an amino group, alkoxy group, or phenoxy group; Q is a substituted or unsubstituted phenyl; and $R_{10}$ and $R_{11}$ are H or a substituted or unsubstituted 1 to 6 carbon atom alkyl.

Monomers of the type of formula (I) can be prepared by methods similar to those disclosed in EP 0 190 003 B1, U.S. Pat. No. 4,496,650, and U.S. Pat. No. 4,716,234, which are incorporated herein by reference, or by methods described below in more detail.

The polymer latexes are preferably prepared by emulsion polymerization. Emulsion polymerization is well known in the art and is described, for example, in F. A. Bovey, *Emulsion Polymerization,* issued by Interscience Publishers Inc. New York, 1955. Examples of the chemical initiators which may be used include a thermally decomposable initiator, for example, a persulfate (such as ammonium persulfate, potassium persulfate, etc), hydrogen peroxide, 4,4'-azobis(4-cyanovaleric acid), and redox initiators such as hydrogen peroxide-iron(II) salt, potassium persulfate-sodium hydrogensulfate, cerium salt-alcohol, etc. Emulsifiers which may be used in the emulsion polymerization include soap, a sulfonate (for example, sodium N-methyl-N-oleoyltaurate, etc.), a sulfate (for example, sodium dodecyl sulfate, etc.), a cationic compound (for example, hexadecyl trimethylammonium bromide, etc.), an amphoteric compound and a high molecular weight protective colloid (for example, polyvinyl alcohol, polyacrylic acid, gelatin, etc.). Specific examples and functions of the emulsifiers are described in *Belgische Chemische Industrie,* Vol. 28, pages 16–20 (1963).

Emulsion polymerization of solid water-insoluble UV absorbing monomer is usually carried out in an aqueous system or a water/organic solvent system. Organic solvents which can be used are preferably those which have high water miscibility, are substantially inert to the monomers to be used, and do not interrupt usual reactions in free radical addition polymerization. Preferred examples include a lower alcohol having from 1 to 4 carbon atoms (for example, methanol, ethanol, isopropanol, etc.), a ketone (for example, acetone, etc.), a cyclic ether (for example, tetrahydrofuran, etc.), a nitrile (for example, acetonitrile, etc.), an amide (for example, N,N-dimethylforamide, etc.), a sulfoxide (for example, dimethylsulfoxide), and the like. This method is the most direct way of preparing a polymer latex as described in U.S. Pat. Nos. 4,464,462; 4,455,368 and European Patent publication 0 190 003 (1991).

High boiling organic solvents (so-called coupler solvent) can also be added to modify the physical properties of the photographic materials. The loading of high boiling organic solvents into polymer latex was described in the following publications: U.S. Pat. No. 4,199,363, U.S. Pat. No. 4,203,716, U.S. Pat. No. 4,214,047, U.S. Pat. No. 4,247,627, U.S. Pat. No. 4,497,929, and U.S. Pat. No. 4,608,424.

As to the method of loading the high boiling point organic solvent in the polymer latex, "loading" a polymer latex is generally described in U.S. Pat. No. 4,199,363 for example. There are several methods of loading the high boiling point solvents into the polymer latex. First, an aqueous dispersion of a high boiling point solvent (or mixture of such solvents) is prepared by the conventional colloid mill process in the presence of gelatin. This dispersion is then blended with the polymer latex such that the weight ratio of high boiling, water immiscible organic solvent to polymer latex is between 0.1 to 5.0 (that is, 0.1/1 to 5.0/1 of solvent/polymer latex), and more preferably between 0.2 to 3.0 (that is, 0.2/1 to 3.0/1 of solvent/polymer latex).

In a second method of loading the polymer latex, the high boiling point solvent is loaded into the polymeric UV absorbing agent in the presence of low boiling organic solvents, such as methanol or acetone. The auxiliary solvent is then evaporated with a rotary evaporator. The same weight ratios of high boiling, water immiscible organic solvent can be used as in the above method.

Loading of a polymer latex is also described, for example, in U.S. Pat. No. 4,203,716, U.S. Pat. No. 4,214,047, U.S. Pat. No. 4,247,627, U.S. Pat. No. 4,497,929 and U.S. Pat. No. 4,608,424.

Conventional (that is, monomeric) UV absorbers can also be loaded into the UV absorbing polymer latexes of the photographic elements of the present invention to alter their photographic performance. Examples of such conventional UV absorbing agents which can be used include: 2-(2-hydroxy-5-methylphenyl)-2H-benzotriazole, 2-(2-hydroxy- 3,5-di-tert-butylphenyl)-2H-benzotriazole, 2-(2-hydroxy-3-tert-butyl-5 -methylphenyl)-2H-benzotriazole, 2-(2-hydroxy-3,5-di-tert-butylphenyl)-5-chloro-2H-benzotriazole, 2-(2-hydroxy-3,5-di-tert-amylphenyl)-2H-benzotriazole, 2-(2-hydroxy-3,5-di(1,1-dimethylbenzyl)-phenyl)-2H-benzotriazole, 2-(2-hydroxy-5-tert-octylphenyl)-2H-benzotriazole. Other types of UV absorbing agents include p-hydroxybenzoates, phenylesters of benzoic acid, salicylanilides and oxanilides, diketones, benzylidene malonate, esters of 1-cyano-β-phenylcinnamic acid, and organic metal photostabilizers, and others, as described in J. F. Rabek, *Photostabilization of Polymers, Principles and Applications,* Elsevier Science Publishers LTD, England, page 202–278 (1990).

The loaded polymer dispersion is incorporated into the photographic element (typically into a gelatin gel thereof) in an amount of between 0.2 g/m$^2$ to 10 g/m$^2$, and more preferably between 0.5 g/m$^2$ to 5.0 g/m$^2$. Furthermore, the weight ratio of high boiling, water immiscible organic solvent to polymer latex is preferably between 0.1 to 5.0 (that is, 0.1/1 to 5.0/1 of solvent/polymer latex), and more preferably between 0.2 to 3.0 (that is, 0.2/1 to 3.0/1 of solvent/polymer latex).

The polymer latex is added to any one or more of the layers (for example, a hydrophilic colloid layer) of a photographic light-sensitive material (for example, a silver halide photographic light-sensitive material), such as a surface protective layer, an intermediate layer or a silver halide emulsion layer, and the like. For example, in photographic paper the UV absorbing polymer latex may be positioned above and/or below the red sensitive layer (typically adjacent to it), the red sensitive layer typically being the uppermost light sensitive layer in color paper, or even completely or partially within the red sensitive layer.

Photographic elements according to the present invention will typically have at least one light sensitive silver halide emulsion layer and a non-light sensitive layer, with the ultraviolet absorbing compound of the present invention being typically (but not necessarily) located in the non-light sensitive layer. More preferably, a photographic element of the present invention will have the non-light sensitive layer containing the ultraviolet absorbing polymer located above all light sensitive layers. However, it is also contemplated that the ultraviolet absorbing polymer can additionally be present in another layer, such as an interlayer (or even a light sensitive layer), particularly an interlayer located between red and green sensitive layers in an element having blue, green and red-sensitive layers coated in that order, on a support (particularly a paper support). Any layer of the photographic element in which the UV absorbing compounds of formula (I) are located will normally be a gel layer.

The UV absorbing compound is typically provided in a given layer of a photographic element by coating the hydrophilic colloid material (such as a gelatin emulsion) which contains the latex, onto a support or another previously coated layer forming part of the element.

The photographic elements made by the method of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1994, Number 365, Item 36544, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I. That publication, and all other references cited in this application, are incorporated herein by reference to them.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred to that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure,* Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure,* June 1975, item 13452 and U.S. Pat. No. 3,772,031.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor, *The Theory of the Photographic Process,* 4th Edition, Macmillan, New York, 1977. In the case of processing a negative working element, th element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The present invention will be further described in the examples below.

EXAMPLES

Synthesis of Monomer M-1

Monomer M-1 can be synthesized from a commercial monomeric UV absorber such as Tinuvin 1130, Tinuvin 384 or Tinuvin 109 (each of the foregoing is a trade name of Ciba-Geigy Inc.). The synthetic scheme is shown below.

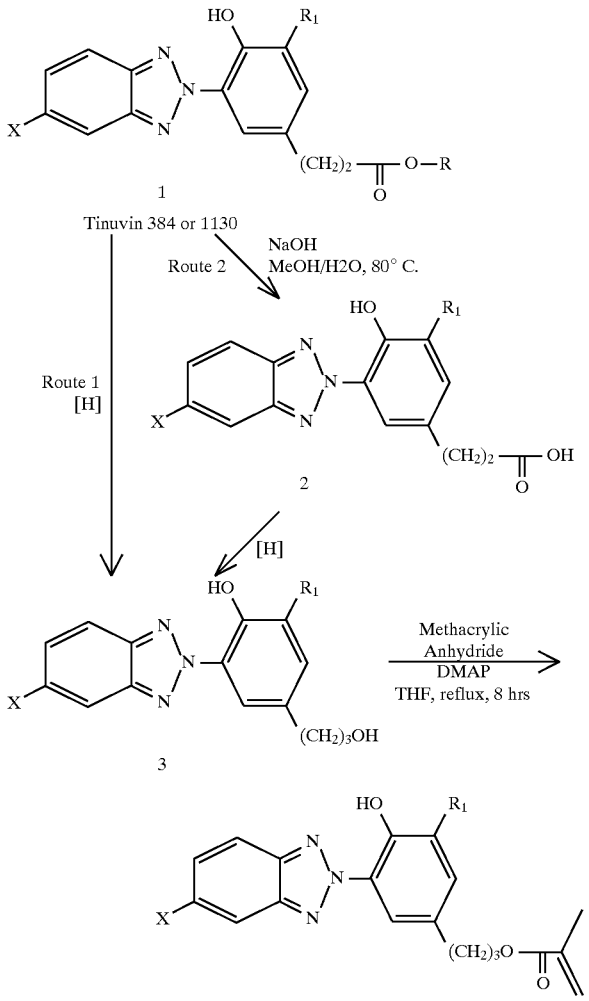

1. Synthesis of 2-hydroxy-3-tert-butyl-5-(3-hydroxypropyl)-2H-benzotriazole (3)

a. Method I 50 g of Tinuvin 1130 (trade name of Ciba-Geigy), 40 g of sodium hydroxide, 300 mL of methanol and 300 ml of water were mixed and heated at 80° C. overnight. Solution was cooled to RT and poured into dil. HCL solution with good agitation. White solid precipitated right away. White solid was collected by filtration and washed with water several times. The wet solid was recrystallized in hot 3A alcohol. 30 g of 2-hydroxy-3-tert-butyl-5-carboxyethylphenyl 2-benzotriazole (2) was obtained. NMR confirmed the structure.

0.57 g of lithium aluminum hydride (0.015 mole), and 10 mL of dry THF were charged in a 100 ml 3 neck flask under nitrogen. The flask was cooled to 10° C. with ice bath. 3.39 g of compound 2 (0.01 mole) was dissolved in 25 mL dry THF and added slowly to the flask to keep temperature below 10° C. Total addition time was 30 minutes. The solution was raised to reflux for two hours. TLC (dichloromethane/ethyl acetate=9:1) showed the reaction was complete. Solution was cooled to 10° C. and added with 25 ml ethyl ether and 2 ml of saturated sodium sulfate. Solution was filtered and the solid residue was washed with ethyl acetate. Organic layer was combined. 2-hydroxy-3-tert-butyl-5-(3-hydroxypropy)-2H-benzotriazle (3), was isolated by column chromatography with dichloromethane/ethyl acetate (9:1) as eluent. Yield was 2.5 g (77% ). NMR confirmed the structure.

b. Method II 22.58 g of Tinuvin 384 (trade name of Ciba-Geigy) (0.05 mole) and 100 ml of dry THF were mixed and cooled to 20° C. with ice bath in a 500 ml 4 neck flask equipped with mechanical stirrer, thermometer and dropping funnel. 28.9 g of Vitride (trade name of Eastman Kodak Company) (0.1 mole) was added dropwisely through dropping funnel over 30 mins to keep temperature below 20° C. Solution was heated to reflux for one hour and then cooled to room temperature. Solution was poured slowly to a diluted sulfuric acid (15 ml conc. sulfuric acid in 100 mL water and 200 mL of crushed ice) and extracted with ethyl ether. Organic layer was separated and washed with 10% HCL solution and saturated NaCl solution, and dried over magnesium sulfate. Crude 2-hydroxy-3-tert-butyl-5-(3-hydroxypropyl)-2H-benzotriazole (3) was obtained. NMR confirmed the structure.

2. Synthesis of 2-hydroxy-3-tert-butyl-5-(3-methacryloxypropyl)-2H-benzotriazole (M-1)

Crude compound 3 (ca. 0.05 mole) from method (b) above, 8.48 g of methacrylic anhydride (0.055 mole), 0.611 g of dimethylamino pyridine (0.005 mole), 0.2 g of pyragallol, and 200 ml of dry THF were mixed and refluxed under nitrogen. Two hours later, 3.08 g of methacrylic anhydride (0.02 mole) was further added and reaction mixture was heated overnight. Solvent was removed with an rotarary evaporator and the viscous liquid was redissolved in dichloromethane. The solution passed through a silica gel column to remove the impurities. Solvent was evaporated and the liquid residue was recrystallized in methanol. 18.7 g of M-1 monomer was obtained as pale white solid (95% yield overall). NMR and combustion analysis confirmed the structure. Melting point was 62°–63.2° C. λmax in dichloromethane are 345 nm and 303 nm.

3. Synthesis of 2-hydroxy-3-tert. butyl-5-(p-vinylbenzyloxypropyl-2H-benzotriazole (M-6)

Crude compound 3 (9.75 g, 0.03 mole), 0.1 g of potassium iodide, and 100 ml dry THF were mixed in a 500 ml 3 neck flask equipped with condenser, thermometer, and nitrogen inlet. 1.98 g of sodium hydride (0.066 mole, 80% in mineral oil) was added all at once. After hydrogen gas ceased evolving, 5.04 g of p-vinylbenzyl chloride (0.033 mole) diluted with 10 ml dry THF was added dropwisely. Solution was refluxed overnight. Solution was poured into cold 10% HCl solution and extracted with ethyl acetate. Organic layer was washed with sat. NaCl solution and dried over magnesium sulfate. M-6 was isolated by column chromaography with Ligroin 950/dichloromethane (7/3 to 5/5) as eluent. Yield was 6 g (47.3%). NMR and combustion analysis confirmed the structure. λmax in dichloromethane are 345 nm and 303 nm.

Synthesis of Polymers:

Synthesis of P-1 is described below as typical example. 115 g of deionized water, 0.87 g of sodium N-methyl-N-oleoyltaurate (Igepon T-77), and 10 g of acetone were mixed in a 0.5 L 4-neck round bottom flask equipped with a mechanical stirrer, nitrogen inlet, and condenser. The flask was immersed in a constant temperature bath at 80° C. and heated for 30 mins with nitrogen purging through. 2.09 g of 5% potassium persulfate was added. 5 mins later, monomer solution comprising 3.935 g of M-1, 1.28 g of butyl acrylate, 50 mL of N,N-dimethylforamide and 8 mL of acetone and cofeed solution comprising 0.43 g of Igepon T-77, 1.04 g of 5% potassium persulfate and 20 mL water were pumped into the reactor together over three hours. The polymerization was continued for 8 hours. The latex was cooled, filtered and dialyzed against distilled water overnight and concentrated to 4.39% solid with Amicon's Ultrafiltration unit. The Z-average particle size measured by Malvern's Autosizer IIC was 93 nm. The elemental analysis confirmed the composition. Table 1 shows the physical properties of polymer P-1 to P-4. Polymers P-1 to P-4 and comparison examples CP-1 to CP-4 were prepared by the same method, and their composition are also identified in Table 1 below.

TABLE 1

| Polymer | Composition | Particle Size (Z-Average) | Reference |
|---|---|---|---|
| P-1 | M-1:butyl acrylate(1:1) | 93 | Invention |
| P-2 | M-1:butyl acrylate(1:2) | 126 | Invention |
| P-3 | M-1 homopolymer | 16 | Invention |
| P-4 | M-1:butyl acrylate(1:1) | 97.5 | Invention |
| P-5 | M-6:Ethyl acrylate: NaAMPS (1:1:0.1) | 124 | Invention |
| comparative polymer 1 (CP-1) | Structure below | 85 | Compound of EP application 190 003 |
| comparative polymer 2 (CP-2) | Structure below | 90 | Compound of U.S. application no. 907,008 |
| comparative polymer 3 (CP-3) | Structure below | 63 | Compound of U.S. 4,166,109 |
| comparative polymer 4 (CP-4) | Structure below | 85 | Compound of U.S. 5,099,027 |

NaAMPS = sodium salt of 2-acryloamido-2-methylpropane sulfonic acid.

The structures of comparison polymers CP-1 to CP-4 are shown below.

Comparison Polymer CP-1

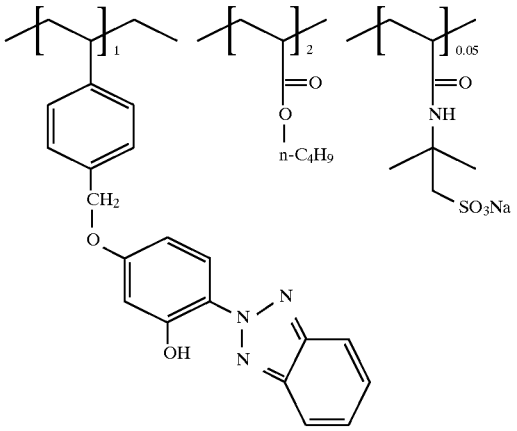

-continued

Comparison Polymer CP-2

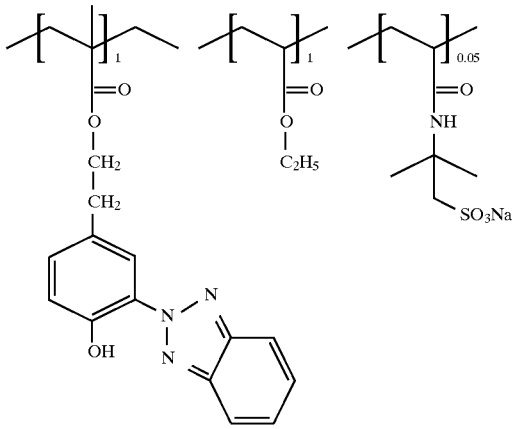

Comparison Polymer CP-3

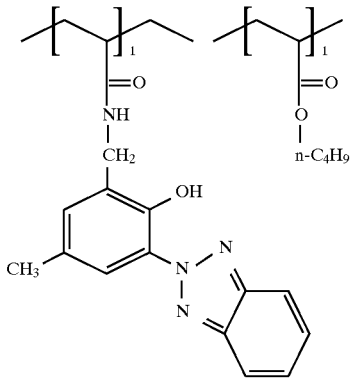

Comparison Polymer CP-4

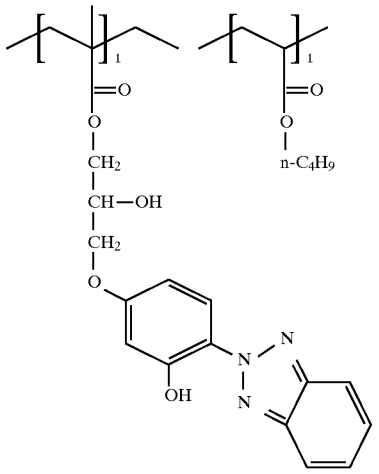

Photographic Evaluation:

It is essential that the UV absorbing polymer itself have good light stability in a photographic element. This is necessary to protect a photographic image from fading and to reduce the formation of stains from unreacted couplers on long term light exposure. Therefore, measurements were made of light stability of the UV absorbing polymers required by the present invention, as well as of photographic dye fading. The coating formats for the light stability and dye fade evaluation, below, are different. For the evaluation of absorption spectrum and light stability, the polymeric UVA was coated on a clear support. The coating format is as follows:

| | | |
|---|---|---|
| Overcoat | 125 | mg/ft$^2$ gel |
| | 1.05 | mg/ft$^2$ Alkanol XC (a surfactant from DuPont) |
| | 0.394 | mg/ft$^2$ FT-248 (a surfactant from DuPont) |
| | 4.95 | mg/ft$^2$ BVSME (a hardner) |
| UV Layer | 150 | mg gel |
| | 4 | mg/ft$^2$ Alkanol-XC |
| | 0.2 | mmole/ft$^2$ UVA |
| //Cellulose Triacetate Film Support////// | | |

The light stability test were carried out by the typical Xenon fadeometer exposure with a Xe arc lamp as a light source at 25° C. for four weeks. Samples were irradiated at a distance such that the irradiance on the sample was 50 Klux (so-called HIS test). The UV absorption spectrum of each sample was taken both before and after irradiation, and the % loss of the absorbance at 360 nm was used as index for the light stability of the UV absorbing polymer. The foregoing figures as provided in Table I below as "% Loss (@360 nm, 4 wks HIS)".

For the evaluation of absorption characteristics, as well as on light induced discoloration of imaging dyes and light induced density increase in the unexposed area (Dmin), photographic elements in the form of color photographic paper were prepared with the layer arrangement shown below. The coating format for the evaluation of these properties is shown below.

| Layer No. | Layer Name | mg/ft$^2$ unless otherwise indicated |
|---|---|---|
| 8 | Protective Layer | 125 Gelatin |
| | | 1.05 Alkanol-XC |
| | | 0.394 FT-248 |
| | | 12.87 BVSME |
| 7 | UV Layer | 150 Gelatin |
| | | 4 Alkanol-XC |
| | | amounts of UVA used are shown in Table 2 |
| 6 | Interlayer | 2.0 Scavanger 1 |
| | | 100 Gelatin |
| 5 | Cyan layer | 100 Gelatin |
| | | 39.3 Cyan Coupler |
| | | 0.54 Scavenger |
| | | 16.7 Red Sensitized AgCl Emulsion |
| | | 21.44 Coupler Solvent |
| 4 | Interlayer | 65.0 Gelatin |
| | | 4.02 Scavenger 1 |
| 3 | Magenta layer | 115.0 Gelatin |
| | | 36.14 Magenta Coupler |
| | | 19.2 Magenta Stabilizer |
| | | 26.65 Green Sensitized AgCl Emulsion |
| | | 14.25 Coupler Solvent |
| 2 | Interlayer | 70.0 Gelatin |
| | | 8.75 Scavenger 1 |
| 1 | Yellow layer | 140.0 Gelatin |
| | | 68.03 Yellow Coupler |
| | | 23.63 Blue Sensitized AgCl Emulsion |
| | | 0.88 Scavenger 2 |
| Support | Sublayer 1 | Resin Coat: Titanox and Optional Brightner Dispersed in Polyethylene |
| | Sublayer 2 | Paper |
| | Sublayer 3 | Resin Coat: Polyethylene |

All image couplers, scavengers and image stabilizers are co-dispersed in dibutyl phthalate by the conventional milled process. The structures of the foregoing are as follows:

Magenta coupler

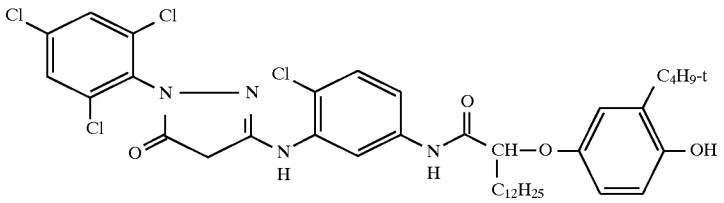

Yellow Coupler

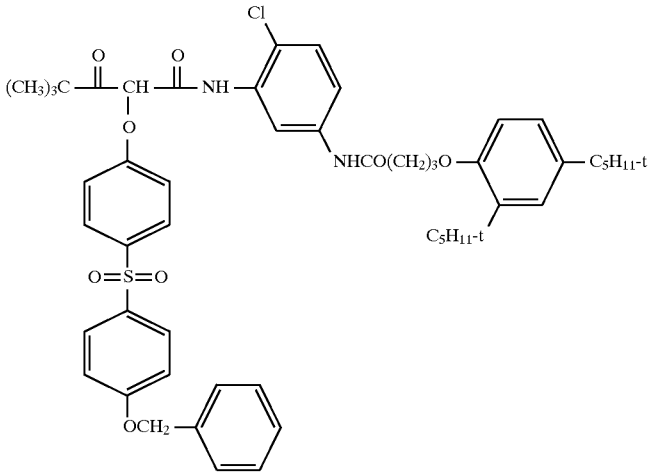

-continued

Cyan Coupler

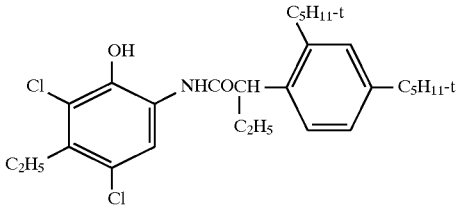

Scavenger 1

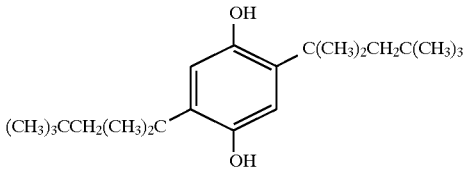

Scavenger 2

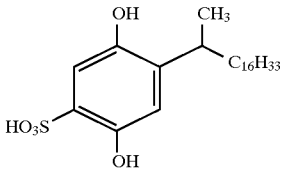

Stabilizer

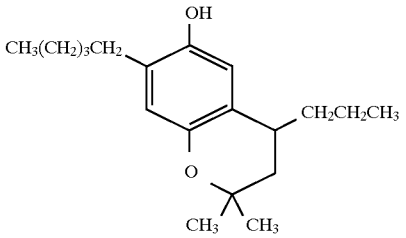

The photographic papers with the arrangement described above were processed by the well-known RA-4 process (see, for example, Research Disclosure I). Dmin increase in the unexposed area and the image dye stability, which are the two major advantages of photographic elements of the present invention, were evaluated as outlined below.

1) Dmin readings were measured by Spectrogard on fresh and incubated samples to study the blue density increase (yellowing) caused by light exposure. The samples were subjected to HIS test for 4 weeks. The measured values for blue density increase are shown in Table 2 below as "Blue Dmin (4 wks HIS printout)". Preferably, the blue density increase should be as low as possible.

2) Photographic elements with the layer structure described above were exposed with step tablet wedge to three different colors (red, green, blue) on a sensitometer and subsequently processed by the RA-4 process to provide cyan, magenta, and yellow colors. The samples were subjected to a fading test with a Xenon lamp with filtered glass (50 Klux) (or so-called HID test) for 4 weeks. Dye density loss from the original density of 1.0 was measured and the data was used as the index for the image dye stability. Results are shown in Table 2 as "4 wks HID Image Dye Fade from density 1.0".

TABLE 2

| UVA | Laydown (mmole/ft$^2$) | % Loss (@360 nm,4 wks HIS) | Blue Dmin (4 wks HIS printout) | 4 wks HID Image Dye Fade from density 1.0 Cyan | Magenta | Yellow | Remark |
|---|---|---|---|---|---|---|---|
| CP-1 | 0.17 | 7.2 | 0.112 | −0.22 | −0.77 | −0.65 | comparison |
| CP-2 | 0.17 | 5.6 | 0.127 | −0.21 | −0.81 | −0.69 | comparison |
| CP-3 | 0.17 | 32 | 0.155 | −0.2 | −0.73 | −0.60 | comparison |
| CP-4 | 0.17 | 10.4 | 0.156 | −0.16 | −0.83 | −0.75 | comparison |
| P-1 | 0.17 | 5.13 | 0.106 | −0.20 | −0.75 | −0.62 | Invention |

TABLE 2-continued

| UVA | Laydown (mmole/ft$^2$) | % Loss (@360 nm,4 wks HIS) | Blue Dmin (4 wks HIS printout) | 4 wks HID Image Dye Fade from density 1.0 Cyan | Magenta | Yellow | Remark |
|---|---|---|---|---|---|---|---|
| | 0.204 | | 0.098 | −0.20 | −0.74 | −0.62 | Invention |
| | 0.238 | | 0.094 | −0.16 | −0.73 | −0.57 | Invention |
| P-2 | 0.17 | 2.50 | 0.107 | −0.17 | −0.72 | −0.61 | Invention |
| | 0.204 | | 0.096 | −0.19 | −0.72 | −0.57 | Invention |
| | 0.238 | | 0.098 | −0.16 | −0.69 | −0.62 | Invention |
| P-3 | 0.17 | 7.45 | 0.102 | −0.19 | −0.74 | −0.64 | Invention |
| | 0.204 | | 0.1 | −0.21 | −0.73 | −0.61 | Invention |
| | 0.238 | | 0.099 | −0.17 | −0.71 | −0.63 | Invention |
| P-4 | 0.17 | 6.20 | 0.098 | −0.19 | −0.75 | −0.63 | Invention |
| | 0.204 | | 0.096 | −0.19 | −0.74 | −0.65 | Invention |
| | 0.238 | | 0.092 | −0.20 | −0.73 | −0.63 | Invention |
| P-5 | 0.2 | 4.3 | 0.101 | −0.24 | −0.77 | −0.69 | Invention |

The significant figures from Table 2 are, of course, Dye Fade and Printout (since these are what an observer can see). From Table 2 above, it is clear that photographic elements of the present invention which contain the required UV absorbing polymers, had low image dye fade while at the same time had low printout. The comparatives with the best dye fade had significantly worse printout. For example, CP-3 provided cyan, magenta and yellow dye fade values of −0.2, −0.73 and −0.60, respectively but had a printout of 0.155. On the other hand, inventive polymers providing the same or better dye fade (for example, P-2) all provided much less printout (for example, the highest figure was 0.107 provided by P-2).

The preceding examples are set forth to illustrate specific embodiments of this invention and are not intended to limit the scope of the compositions or materials of the invention. It will be understood that variations and modifications can be effected within the spirit and scope of the invention.

We claim:

1. A photographic element having at least one layer containing a light sensitive silver halide emulsion and at least one layer which is not light sensitive, the element having in at least one of the layers an ultraviolet absorbing polymer which includes units formed from monomers of the structure of formula (I):

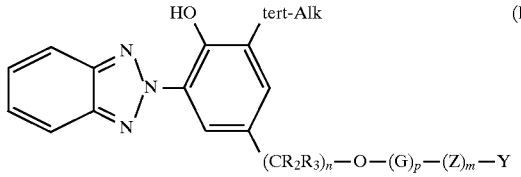

(I)

wherein:

n is an integer of 1 to 6;

p and m are, independently, 0 or 1;

tert-Alk is a 4 to 10 carbon atom tertiary alkyl group;

G is —CO—, —C(O)—, —C(O)NH—, or —$SO_2$—;

$R_2$ and $R_3$ are, independently, H, halogen, alkyl group or alkoxy group, and if n is more than 1 all of the $R_2$ may be the same or different and all of the $R_3$ may be the same or different; the phenyl ring phenol group may be further substituted or unsubstituted;

Z is an arylene group, alkylene group, or alkylene group which is interrupted by O, N or a group of the type which G can represent; and Y is an ethylenically unsaturated polymerizable group; and wherein the benzene ring of the benzotriazole has no further substituents.

2. A photographic element according to claim 1 wherein at least one light sensitive silver halide containing emulsion layer also contains a color coupler which reacts with an oxidized developer during development to produce a colored dye.

3. A photographic element according to claim 1 wherein n is 1.

4. A photographic element according to claim 1 wherein the monomers of structure (I) are of formula (Ib) below:

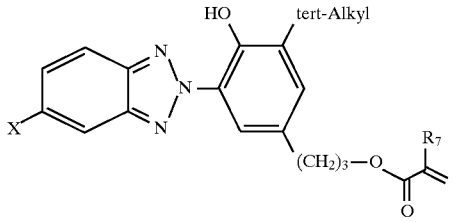

(Ib)

wherein X is H and $R_7$ is H or a 1 to 4 carbon atom alkyl.

5. A photographic element according to claim 1 wherein the ultraviolet absorbing polymer is present in the photographic element in an amount of between 0.2 g/m$^2$ and 10 g/m$^2$.

6. A photographic element according to claim 1 wherein the ultraviolet absorbing polymer is a copolymer additionally having repeating units of either the formula:

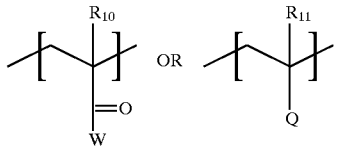

wherein: W is an amino group, alkoxy group, or phenoxy group; Q is a phenyl group; and $R_{10}$ and $R_{11}$ are H or a 1 to 6 carbon atom alkyl group.

7. A photographic element according to claim 1 wherein the ultraviolet absorbing polymer is a copolymer and the molar ratio of repeating units other than formula I to repeating units of formula I, is no more than 4 to 1.

8. A photographic element according to claim 1 wherein the ultraviolet absorbing polymer is present in a layer of the photographic element which is above all light sensitive silver halide containing layers of the element.

9. A photographic element according to claim 1 wherein the layers of the element are all gelatin layers.

* * * * *